US009938823B2

(12) United States Patent
Deville et al.

(10) Patent No.: US 9,938,823 B2
(45) Date of Patent: Apr. 10, 2018

(54) COMMUNICATING POWER AND DATA TO A COMPONENT IN A WELL

(75) Inventors: Benoit Deville, Saint-Germain-en-Laye (FR); Marian Faur, Massy (FR); Charley Martinez, Moissy Cramayel (FR)

(73) Assignee: SCHLUMBERGER TECHNOLOGY CORPORATION, Houston, TX (US)

( * ) Notice: Subject to any disclaimer, the term of this patent is extended or adjusted under 35 U.S.C. 154(b) by 1160 days.

(21) Appl. No.: 13/397,078

(22) Filed: Feb. 15, 2012

(65) Prior Publication Data

US 2013/0206387 A1 Aug. 15, 2013

(51) Int. Cl.
*E21B 4/04* (2006.01)
*E21B 47/12* (2012.01)
*E21B 41/00* (2006.01)

(52) U.S. Cl.
CPC ..... *E21B 47/12* (2013.01); *E21B 41/00* (2013.01)

(58) Field of Classification Search
CPC ..... E21B 47/12
USPC ..... 340/853.1
See application file for complete search history.

(56) References Cited

U.S. PATENT DOCUMENTS

| | | | |
|---|---|---|---|
| 2,214,064 | A | 9/1940 | Niles |
| 2,379,800 | A | 7/1945 | Hare |
| 2,452,920 | A | 11/1948 | Gilbert |
| 2,470,303 | A | 5/1949 | Greenough |
| 2,782,365 | A | 2/1957 | Castel |
| 2,797,893 | A | 7/1957 | McCune et al. |
| 2,889,880 | A | 6/1959 | Hughes |
| 3,011,342 | A | 12/1961 | Simm |
| 3,199,592 | A | 8/1965 | Jacob |
| 3,206,537 | A | 9/1965 | Steward |
| 3,344,860 | A | 10/1967 | Voetter |
| 3,363,692 | A | 1/1968 | Bishop |
| 3,572,032 | A | 3/1971 | Terry |
| 3,659,259 | A | 4/1972 | Chaney, Jr. et al. |
| 3,913,398 | A | 10/1975 | Curtis |
| 4,027,286 | A | 5/1977 | Marosko |
| 4,133,384 | A | 1/1979 | Allen et al. |

(Continued)

FOREIGN PATENT DOCUMENTS

| | | | |
|---|---|---|---|
| EP | 795679 | A2 | 9/1997 |
| EP | 823534 | A1 | 2/1998 |

(Continued)

OTHER PUBLICATIONS

Brown, G.A., SPE 62952. "Using Fibre-Optic Distributed Temperature Measurements to Provide Real-Time Reservoir Surveillance Data on Wytch Farm Field Horizontal Extended-Reach Wells" Society of Petroleum Engineers Inc. 2000, pp. 1-11.

(Continued)

*Primary Examiner* — Amine Benlagsir

(57) ABSTRACT

An apparatus includes a circuit to receive power and data over a communication medium, where the circuit is to separate the power and the data. An electronic switch couples the power output by the circuit to a downhole electrical component for use in a well. According to other implementations, an electro-hydraulic actuator includes an outer housing defining a first hydraulic chamber and a second hydraulic chamber, where a seal for one of the hydraulic chambers is achieved without use of an elastomeric seal.

12 Claims, 13 Drawing Sheets

(56) References Cited

U.S. PATENT DOCUMENTS 4,241,787 A 12/1980 Price
4,415,205 A 11/1983 Rehm et al.
4,484,628 A 11/1984 Lammon, II
4,559,818 A 12/1985 Tsang et al.
4,573,541 A 3/1986 Josse et al.
4,597,290 A 7/1986 Bourdet et al.
4,733,729 A 3/1988 Copeland
4,806,928 A 2/1989 Veneruso
4,850,430 A 7/1989 Copeland et al.
4,901,069 A 2/1990 Veneruso
4,945,995 A 8/1990 Tholance et al.
4,953,636 A 9/1990 Mohn
4,969,523 A 11/1990 Martin et al.
5,183,110 A 2/1993 Logan et al.
5,269,377 A 12/1993 Martin
5,278,550 A 1/1994 Rhein-Knudsen et al.
5,301,760 A 4/1994 Graham
5,311,936 A 5/1994 McNair et al.
5,318,121 A 6/1994 Brockman et al.
5,318,122 A 6/1994 Murray et al.
5,322,127 A 6/1994 McNair et al.
5,325,924 A 7/1994 Bangert et al.
5,330,007 A 7/1994 Collins et al.
5,337,808 A 8/1994 Graham
5,353,876 A 10/1994 Curington et al.
5,388,648 A 2/1995 Jordan, Jr.
5,398,754 A 3/1995 Dinhoble
5,411,082 A 5/1995 Kennedy
5,427,177 A 6/1995 Jordan, Jr. et al.
5,435,392 A 7/1995 Kennedy
5,439,051 A 8/1995 Kennedy et al.
5,454,430 A 10/1995 Kennedy et al.
5,457,988 A 10/1995 Delatorre
5,458,199 A 10/1995 Collins et al.
5,458,209 A 10/1995 Hayes et al.
5,462,120 A 10/1995 Gondouin
5,472,048 A 12/1995 Kennedy et al.
5,474,131 A 12/1995 Jordan, Jr. et al.
5,477,923 A 12/1995 Jordan, Jr. et al.
5,477,925 A 12/1995 Trahan et al.
5,499,680 A 3/1996 Walter et al.
5,520,252 A 5/1996 McNair
5,521,592 A 5/1996 Veneruso
5,533,573 A 7/1996 Jordan, Jr. et al.
5,542,472 A 8/1996 Pringle et al.
5,597,042 A 1/1997 Tubel et al.
5,655,602 A 8/1997 Collins
5,680,901 A 10/1997 Gardes
5,697,445 A 12/1997 Graham
5,706,896 A 1/1998 Tubel et al.
5,730,219 A 3/1998 Tubel et al.
5,823,263 A 10/1998 Morris et al.
5,831,156 A 11/1998 Mullins
5,871,047 A 2/1999 Spath et al.
5,871,052 A 2/1999 Benson et al.
5,875,847 A 3/1999 Forsyth
5,915,474 A 6/1999 Buytaert et al.
5,918,669 A 7/1999 Morris et al.
5,941,307 A 8/1999 Tubel
5,941,308 A 8/1999 Malone et al.
5,944,107 A 8/1999 Ohmer
5,944,108 A 8/1999 Baugh et al.
5,944,109 A 8/1999 Longbottom
5,945,923 A 8/1999 Soulier
5,954,134 A 9/1999 Longbottom
5,959,547 A 9/1999 Tubel et al.
5,960,873 A 10/1999 Alexander et al.
5,967,816 A 10/1999 Sampa et al.
5,971,072 A 10/1999 Huber et al.
5,975,204 A 11/1999 Tubel et al.
5,979,559 A 11/1999 Kennedy
5,992,519 A 11/1999 Ramakrishnan et al.
6,003,606 A 12/1999 Moore et al.
6,006,832 A 12/1999 Tubel et al.
6,035,937 A 3/2000 Gano et al.
6,046,685 A 4/2000 Tubel
6,061,000 A 5/2000 Edwards
6,065,209 A 5/2000 Gondouin
6,065,543 A 5/2000 Gano et al.
6,073,697 A 6/2000 Parlin et al.
6,076,046 A 6/2000 Vasudevan et al.
6,079,488 A 6/2000 Begg et al.
6,079,494 A 6/2000 Longbottom et al.
6,119,780 A 9/2000 Christmas
6,125,937 A 10/2000 Longbottom et al.
6,173,772 B1 1/2001 Vaynshteyn
6,173,788 B1 1/2001 Lembcke et al.
6,176,308 B1 1/2001 Pearson
6,176,312 B1 1/2001 Tubel et al.
6,192,980 B1 2/2001 Tubel et al.
6,192,988 B1 2/2001 Tubel
6,196,312 B1 3/2001 Collins et al.
6,209,648 B1 4/2001 Ohmer et al.
6,244,337 B1 6/2001 Cumming et al.
6,302,203 B1 10/2001 Rayssiguier et al.
6,305,469 B1 10/2001 Coenen et al.
6,310,559 B1 10/2001 Laborde et al.
6,318,469 B1 11/2001 Patel
6,328,111 B1 12/2001 Bearden et al.
6,349,770 B1 2/2002 Brooks et al.
6,354,378 B1 3/2002 Patel
6,360,820 B1 3/2002 Laborde et al.
6,374,913 B1 4/2002 Robbins et al.
6,378,610 B2 4/2002 Rayssiguier et al.
6,415,864 B1 7/2002 Ramakrishnan et al.
6,419,022 B1 7/2002 Jernigan et al.
6,457,522 B1 10/2002 Bangash et al.
6,481,494 B1 11/2002 Dusterhoft et al.
6,510,899 B1 1/2003 Sheiretov et al.
6,513,599 B1 2/2003 Bixenman et al.
6,515,592 B1 2/2003 Babour et al.
6,529,562 B1 * 3/2003 Muraishi ..... H04L 27/04 332/149
6,533,039 B2 3/2003 Rivas et al.
6,568,469 B2 5/2003 Ohmer et al.
6,577,244 B1 6/2003 Clark et al.
6,588,507 B2 7/2003 Dusterhoft et al.
6,614,229 B1 9/2003 Clark et al.
6,614,716 B2 9/2003 Plona et al.
6,618,677 B1 9/2003 Brown
6,668,922 B2 12/2003 Ziauddin et al.
6,675,892 B2 1/2004 Kuchuk et al.
6,679,324 B2 1/2004 Den Boer et al.
6,695,052 B2 2/2004 Branstetter et al.
6,702,015 B2 3/2004 Fielder, III et al.
6,727,827 B1 4/2004 Edwards et al.
6,749,022 B1 6/2004 Fredd
6,751,556 B2 6/2004 Schroeder et al.
6,758,271 B1 7/2004 Smith
6,768,700 B2 7/2004 Veneruso et al.
6,776,256 B2 8/2004 Kostyuchenko et al.
6,787,758 B2 9/2004 Tubel et al.
6,789,621 B2 9/2004 Wetzel et al.
6,789,937 B2 9/2004 Haddad et al.
6,817,410 B2 11/2004 Wetzel et al.
6,828,547 B2 12/2004 Tubel et al.
6,837,310 B2 1/2005 Martin
6,842,700 B2 1/2005 Poe
6,845,819 B2 1/2005 Barrett et al.
6,848,510 B2 2/2005 Bixenman et al.
6,856,255 B2 2/2005 Chalitsios et al.
6,857,475 B2 2/2005 Johnson
6,863,127 B2 3/2005 Clark et al.
6,863,129 B2 3/2005 Ohmer et al.
6,864,801 B2 3/2005 Tabanou et al.
6,896,074 B2 5/2005 Cook et al.
6,903,660 B2 6/2005 Clark et al.
6,911,418 B2 6/2005 Frenier
6,913,083 B2 7/2005 Smith
6,920,395 B2 7/2005 Brown
6,942,033 B2 9/2005 Brooks et al.
6,950,034 B2 9/2005 Pacault et al.
6,975,243 B2 12/2005 Clark et al.
6,978,833 B2 12/2005 Salamitou et al.

(56) References Cited

U.S. PATENT DOCUMENTS

| | | | | |
|---|---|---|---|---|
| 6,980,940 | B1 | 12/2005 | Gurpinar et al. | |
| 6,983,796 | B2 | 1/2006 | Bayne et al. | |
| 6,989,764 | B2 | 1/2006 | Thomeer et al. | |
| 7,000,696 | B2 | 2/2006 | Harkins | |
| 7,000,697 | B2 | 2/2006 | Goode et al. | |
| 7,007,756 | B2 | 3/2006 | Lerche et al. | |
| 7,040,402 | B2 | 5/2006 | Vercaemer | |
| 7,040,415 | B2 | 5/2006 | Boyle et al. | |
| 7,055,604 | B2 | 6/2006 | Jee et al. | |
| 7,063,143 | B2 | 6/2006 | Tilton et al. | |
| 7,079,952 | B2 | 7/2006 | Thomas et al. | |
| 7,083,452 | B2 | 8/2006 | Eriksson et al. | |
| 7,093,661 | B2 | 8/2006 | Olsen | |
| 7,348,894 | B2 | 3/2008 | Bailey et al. | |
| 2001/0013410 | A1 | 8/2001 | Beck et al. | |
| 2002/0007948 | A1 | 1/2002 | Bayne et al. | |
| 2002/0050361 | A1 | 5/2002 | Shaw et al. | |
| 2002/0096333 | A1 | 7/2002 | Johnson et al. | |
| 2002/0112857 | A1 | 8/2002 | Ohmer et al. | |
| 2003/0010492 | A1* | 1/2003 | Hill | E21B 47/12 166/65.1 |
| 2003/0137302 | A1 | 7/2003 | Clark et al. | |
| 2003/0137429 | A1 | 7/2003 | Clark et al. | |
| 2003/0141872 | A1 | 7/2003 | Clark et al. | |
| 2003/0150622 | A1 | 8/2003 | Patel et al. | |
| 2003/0221829 | A1 | 12/2003 | Patel et al. | |
| 2004/0010374 | A1 | 1/2004 | Raghuraman et al. | |
| 2004/0094303 | A1 | 5/2004 | Brockman et al. | |
| 2004/0164838 | A1 | 8/2004 | Hall et al. | |
| 2004/0173350 | A1 | 9/2004 | Wetzel et al. | |
| 2004/0173352 | A1 | 9/2004 | Mullen et al. | |
| 2004/0194950 | A1 | 10/2004 | Restarick et al. | |
| 2004/0238168 | A1 | 12/2004 | Echols | |
| 2005/0029476 | A1* | 2/2005 | Biester | E21B 33/0355 251/58 |
| 2005/0072564 | A1 | 4/2005 | Grigsby et al. | |
| 2005/0074210 | A1 | 4/2005 | Grigsby et al. | |
| 2005/0083064 | A1 | 4/2005 | Homan et al. | |
| 2005/0087368 | A1 | 4/2005 | Boyle et al. | |
| 2005/0092488 | A1 | 5/2005 | Rodet et al. | |
| 2005/0092501 | A1 | 5/2005 | Chavers et al. | |
| 2005/0115741 | A1 | 6/2005 | Terry et al. | |
| 2005/0149264 | A1 | 7/2005 | Tarvin et al. | |
| 2005/0168349 | A1 | 8/2005 | Huang et al. | |
| 2005/0178554 | A1 | 8/2005 | Hromas et al. | |
| 2005/0194150 | A1 | 9/2005 | Ringgenberg | |
| 2005/0199401 | A1 | 9/2005 | Patel et al. | |
| 2005/0236161 | A1 | 10/2005 | Gay et al. | |
| 2005/0274513 | A1 | 12/2005 | Schultz et al. | |
| 2005/0279510 | A1 | 12/2005 | Patel et al. | |
| 2006/0000604 | A1 | 1/2006 | Jenkins et al. | |
| 2006/0000618 | A1 | 1/2006 | Cho et al. | |
| 2006/0006656 | A1 | 1/2006 | Smedstad | |
| 2006/0016593 | A1 | 1/2006 | Gambier | |
| 2006/0038699 | A1* | 2/2006 | Dodge | G01V 11/002 340/854.8 |
| 2006/0042795 | A1 | 3/2006 | Richards | |
| 2006/0060352 | A1 | 3/2006 | Vidrine et al. | |
| 2006/0065444 | A1 | 3/2006 | Hall et al. | |
| 2006/0077757 | A1 | 4/2006 | Cox et al. | |
| 2006/0086498 | A1 | 4/2006 | Wetzel et al. | |
| 2006/0090892 | A1 | 5/2006 | Wetzel et al. | |
| 2006/0090893 | A1 | 5/2006 | Sheffield | |
| 2006/0124297 | A1 | 6/2006 | Ohmer | |
| 2006/0124318 | A1 | 6/2006 | Sheffield | |
| 2006/0162934 | A1 | 7/2006 | Shepler | |
| 2006/0196660 | A1 | 9/2006 | Patel | |
| 2006/0225926 | A1 | 10/2006 | Madhavan et al. | |
| 2006/0254767 | A1 | 11/2006 | Pabon et al. | |
| 2006/0283606 | A1 | 12/2006 | Partouche et al. | |
| 2007/0012436 | A1 | 1/2007 | Freyer | |
| 2007/0027245 | A1 | 2/2007 | Vaidya et al. | |
| 2007/0044964 | A1 | 3/2007 | Grigar et al. | |
| 2007/0059166 | A1 | 3/2007 | Sheth et al. | |
| 2007/0062710 | A1 | 3/2007 | Pelletier et al. | |
| 2007/0074872 | A1 | 4/2007 | Du et al. | |
| 2007/0107907 | A1 | 5/2007 | Smedstad et al. | |
| 2007/0110593 | A1 | 5/2007 | Sheth et al. | |
| 2007/0116560 | A1 | 5/2007 | Eslinger | |
| 2007/0142547 | A1 | 6/2007 | Vaidya et al. | |
| 2007/0144738 | A1 | 6/2007 | Sugiyama et al. | |
| 2007/0144746 | A1 | 6/2007 | Jonas | |
| 2007/0151724 | A1 | 7/2007 | Ohmer et al. | |
| 2007/0159351 | A1 | 7/2007 | Madhavan et al. | |
| 2007/0162235 | A1 | 7/2007 | Zhan et al. | |
| 2007/0165487 | A1 | 7/2007 | Nutt et al. | |
| 2007/0199696 | A1 | 8/2007 | Walford | |
| 2007/0213963 | A1 | 9/2007 | Jalali et al. | |
| 2007/0216415 | A1 | 9/2007 | Clark et al. | |
| 2007/0227727 | A1 | 10/2007 | Patel et al. | |
| 2007/0235185 | A1 | 10/2007 | Patel et al. | |
| 2007/0271077 | A1 | 11/2007 | Kosmala et al. | |
| 2009/0066535 | A1* | 3/2009 | Patel | E21B 17/028 340/853.2 |
| 2009/0140879 | A1* | 6/2009 | Kamata | G01V 11/002 340/853.2 |
| 2012/0037354 | A1* | 2/2012 | McCoy | F04D 13/10 166/65.1 |
| 2012/0133217 | A1* | 5/2012 | Lemire | H04B 3/542 307/115 |

FOREIGN PATENT DOCUMENTS

| | | | |
|---|---|---|---|
| EP | 1158138 | A2 | 11/2001 |
| EP | 0786578 | B1 | 12/2005 |
| GB | 2274864 | A | 8/1994 |
| GB | 2304764 | A | 3/1997 |
| GB | 2333545 | A | 7/1999 |
| GB | 2337780 | A | 12/1999 |
| GB | 2345137 | A | 6/2000 |
| GB | 2360532 | A | 9/2001 |
| GB | 2364724 | A | 2/2002 |
| GB | 2376488 | A | 12/2002 |
| GB | 2381281 | A | 4/2003 |
| GB | 2392461 | A | 3/2004 |
| GB | 2395315 | A | 5/2004 |
| GB | 2395965 | A | 6/2004 |
| GB | 2401385 | A | 11/2004 |
| GB | 2401430 | A | 11/2004 |
| GB | 2401889 | A | 11/2004 |
| GB | 2404676 | A | 2/2005 |
| GB | 2407334 | A | 4/2005 |
| GB | 2408327 | A | 5/2005 |
| GB | 2409692 | A | 7/2005 |
| GB | 2416871 | A | 2/2006 |
| GB | 2419619 | A | 5/2006 |
| GB | 2419903 | A | 5/2006 |
| GB | 2426019 | A | 11/2006 |
| GB | 2428787 | A | 2/2007 |
| RU | 2136856 | C1 | 9/1999 |
| RU | 2146759 | C1 | 3/2000 |
| RU | 2171363 | C1 | 7/2001 |
| RU | 2239041 | C2 | 10/2004 |
| WO | 199623953 | A1 | 8/1996 |
| WO | 1998050680 | A2 | 11/1998 |
| WO | 1998050680 | A3 | 11/1998 |
| WO | 199858151 | A1 | 12/1998 |
| WO | 199913195 | A1 | 3/1999 |
| WO | 200029713 | A2 | 5/2000 |
| WO | 200171155 | A1 | 9/2001 |
| WO | 200198632 | A1 | 12/2001 |
| WO | 2003023185 | A1 | 3/2003 |
| WO | 2004076815 | A1 | 9/2004 |
| WO | 2004094961 | A1 | 11/2004 |
| WO | 2005035943 | A1 | 4/2005 |
| WO | 2005064116 | A1 | 7/2005 |
| WO | 2006010875 | A1 | 2/2006 |

OTHER PUBLICATIONS

Saputelli, L. et al. "Real-Time Decision-making for Value Creation while Drilling" SPE/IADC Middle East Drilling Technology Conference & Exhibition, Oct. 2003.

(56) References Cited

OTHER PUBLICATIONS

Lanier et al. "Brunei Field Trial of a Fibre Optic Distributed Temperature Sensor (DTS) System in 1,DOOm Open Hole Horizontal Oil Producer" SPE 84324; SPE Annual Technical Conference and Exhibition, Oct. 5-8, 2003.

* cited by examiner

FIG. 3
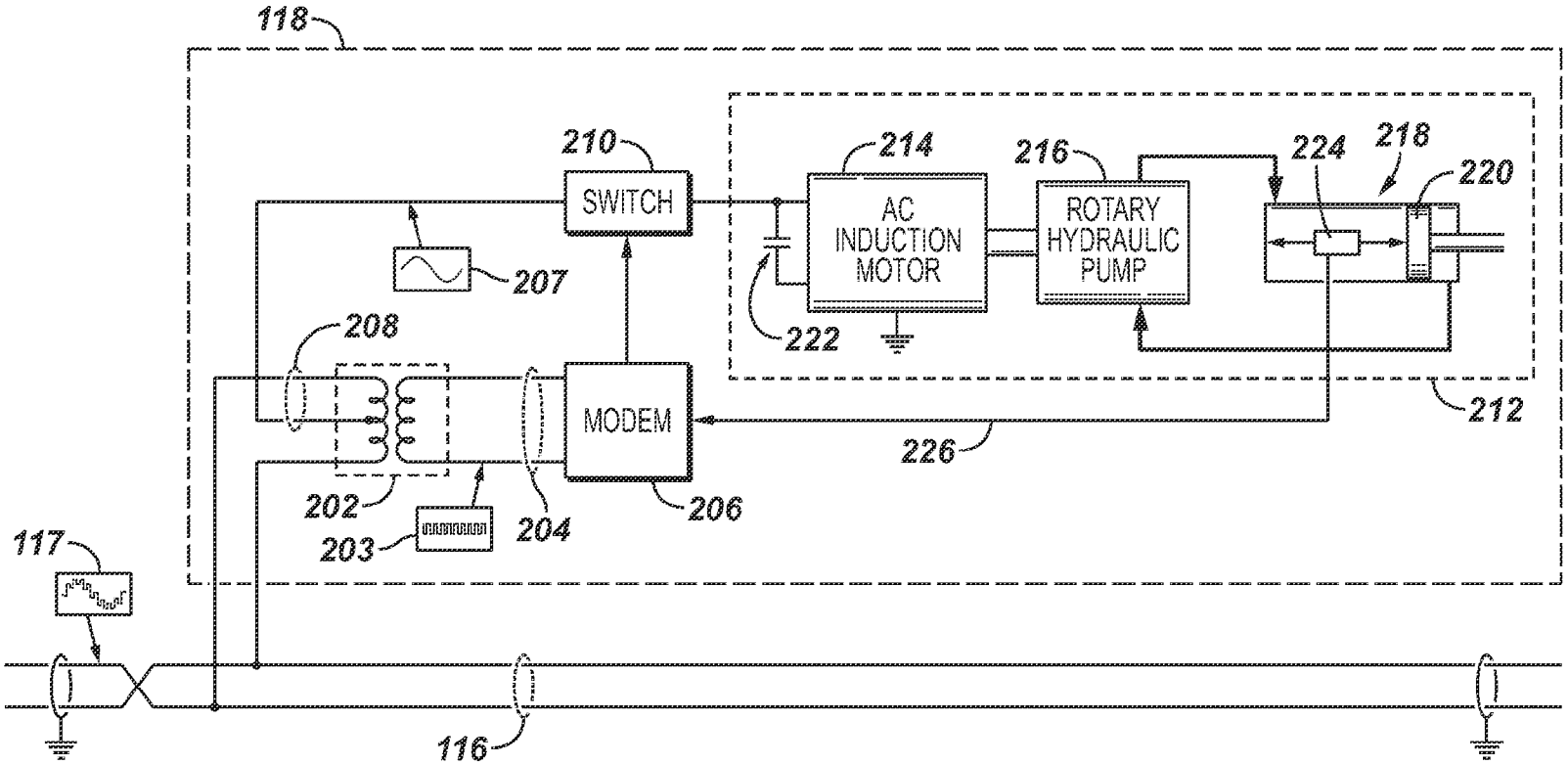
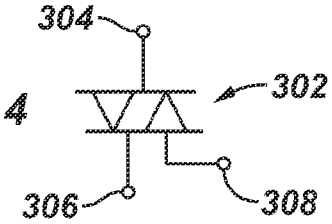
FIG. 4

COMMUNICATING POWER AND DATA TO A COMPONENT IN A WELL

BACKGROUND

A well can be drilled into a subterranean structure for the purpose of recovering fluids from a reservoir in the subterranean structure. Examples of fluids include hydrocarbons, fresh water, or other fluids. Alternatively, a well can be used for injecting fluids into the subterranean structure.

Once a well is drilled, completion equipment can be installed in the well. Examples of completion equipment include a casing or liner to line a wellbore. Also, flow conduits, flow control devices, pumps, and other equipment can also be installed to perform production or injection operations.

SUMMARY

In general, according to some implementations, an apparatus includes a circuit to receive power and data over a communication medium, where the circuit is to separate the power and the data. An electronic switch couples the power output by the circuit to a downhole electrical component (a pump and/or an electro-hydraulic actuator) for use in a well. According to other implementations, an electro-hydraulic actuator includes an outer housing defining a first hydraulic chamber and a second hydraulic chamber, where a seal for one of the hydraulic chambers is achieved without use of an elastomeric seal.

Other features will become apparent from the following description, from the drawings, and from the claims.

BRIEF DESCRIPTION OF THE DRAWINGS

Some embodiments are described with respect to the following figures:

FIGS. 3 and 8 are schematic diagrams of portions of the example arrangements of FIGS. 2 and 7, according to some implementations;

FIG. 4 is a schematic diagram of a bidirectional triode thyristor for use in a downhole electrical module according to some implementations;

DETAILED DESCRIPTION

As used here, the terms "above" and "below"; "up" and "down"; "upper" and "lower"; "upwardly" and "downwardly"; and other like terms indicating relative positions above or below a given point or element are used in this description to more clearly describe some embodiments. However, when applied to equipment and methods for use in wells that are deviated or horizontal, such terms may refer to a left to right, right to left, or diagonal relationship as appropriate.

Various types of components for use in a well can perform electrical communications and can be powered by electrical power. In some examples, a surface unit (located at an earth surface above a well) can include a telemetry module to perform data communication and one or more power supplies to provide power to downhole electrical components. In some examples, the surface unit can include a main power supply (e.g. a main AC or alternating current power supply) and an auxiliary power supply (e.g. an auxiliary AC power supply). The main power supply can be used to deliver power to certain components of a downhole tool, such as sensors, flow control devices, and so forth. The auxiliary power supply can be used to power other components, such as a pump (e.g. electro-hydraulic pump, solenoid pump, piezoelectric pump, and shape memory alloy pump) or an electro-hydraulic actuator. In some examples, separate electrical lines are used to provide power from the main power supply and the auxiliary power supply to corresponding downhole electrical components. Use of separate power supplies, such as the main power supply and the auxiliary power supply, and corresponding separate electrical lines, can be complex and inefficient. For example, use of the separate electrical lines can result in a larger number of electrical connections, which can lead to reduced reliability and increased rig time (time involved in assembling and deploying a tool string at a well site).

In accordance with some embodiments, instead of using separate electrical lines to deliver power from separate power supplies to downhole electrical components, a shared communication medium can be used to deliver both power and data to various downhole components (including pumps and/or electro-hydraulic actuators), which can be connected to the shared electrical communication medium in parallel. As discussed in further detail below, the shared communication medium for delivering power and data can include a twisted wire pair or a coaxial cable. The shared communication medium can be used to carry power to both components such as pumps and/or electro-hydraulic actuators, as well as other components in a tool, such as a modem and so forth.

Figure 1:
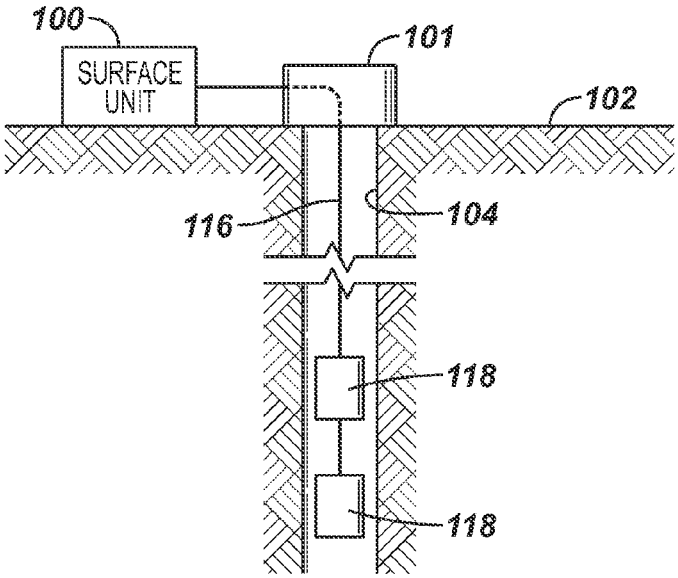
FIG. 1 illustrates an example arrangement of equipment for use with a well, according to some implementations.

FIG. 1 illustrates an example arrangement that includes equipment (e.g. completion equipment or drilling equipment) deployed in a well 104. The downhole equipment can include electrical modules 118 that are able to communicate (both power and data) over a shared communication medium 116. The shared communication medium 116 extends to earth surface equipment located at an earth surface 102 from which the well 104 extends. The earth surface equipment includes a wellhead 101 and a surface unit 100. The shared communication medium extends through the wellhead 101 to the surface unit 100.

Figure 2:
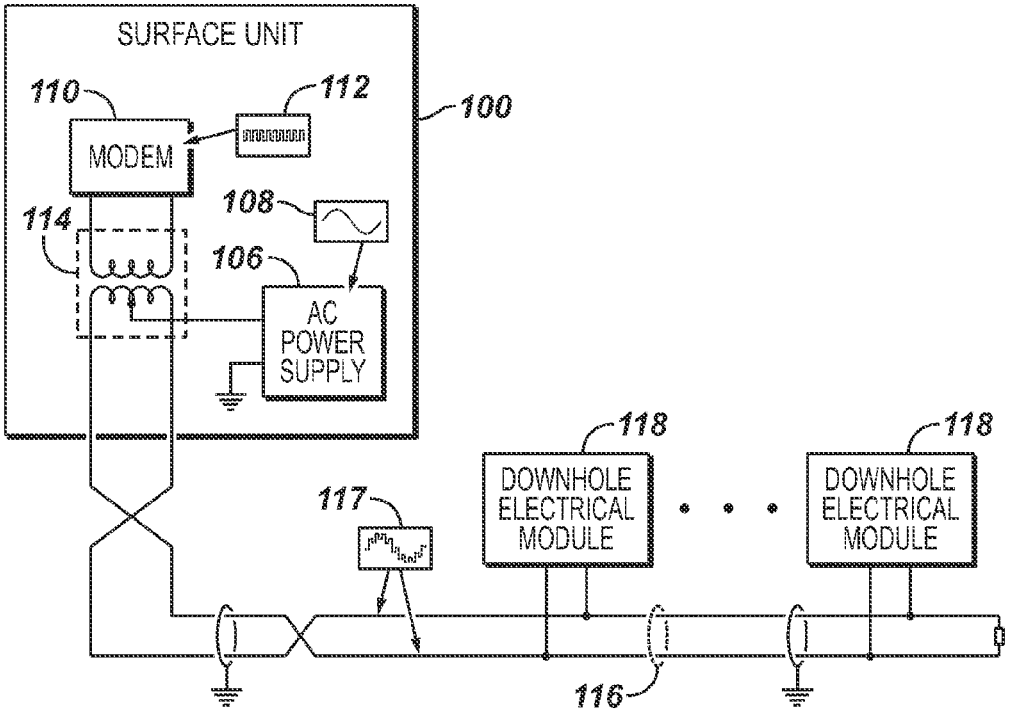
FIGS. 2, 5-7, 9, and 10 are schematic diagrams of example arrangements including a shared communication medium for delivering power and data to downhole electrical modules, in accordance with some implementations.

FIG. 2 is a schematic diagram of an example arrangement that includes the surface unit 100, the shared communication medium 116, and the downhole electrical modules 118 (which can include pumps and/or electro-hydraulic actuators). The surface unit 100 includes a power supply 106, which includes an AC power supply that outputs an AC power signal 108.

The surface unit 100 also includes a telemetry module 110, which can be a modem or other type of telemetry module. The telemetry module 110 is used to perform data communication. The telemetry module 110 is able to input or output a data signal 112. The data signal 112 can be received over the shared communication medium 116 by the telemetry module 110 from a downhole component, such as a sensor. In other examples, the data signal 112 can be a command signal or other signal that is output by the telemetry module 110 for delivery to a downhole component.

The AC power signal 108 can have a relatively low frequency, while the data signal 112 can have a relatively high frequency (higher than the frequency of the AC power signal 108).

In the output direction (from the surface unit 100 to a downhole component), the output data signal from the telemetry module 110 and the output AC power signal from the power supply 106 can be combined by modulation transformer 114. The combined power and data (represented as combined signal 117 in FIG. 1) are supplied over the shared communications medium 116, which can be a twisted wire pair in some examples. A twisted wire pair includes a pair of electrical wires, with the electrical wires being twisted to cross each other at various points. As depicted in FIG. 1, the downhole electrical modules 118 are connected in parallel to the shared communication medium 116.

The combined signal 117 includes the AC power signal delivered in common mode over the twisted wire pair. Summing the signals on the electrical wires of the twisted wire pair produces the AC power signal. The data signal in the combined signal 117 is delivered in differential mode over the twisted wire pair—subtracting the signals on the electrical wires of the twisted wire pair produces the data signal.

Note that in the reverse direction, when data signal from a downhole component is communicated uphole to the surface unit 100, the modulation transformer 114 is able to separate the uphole data signal from the combined signal on the twisted wire pair 116 to provide to the telemetry module 110.

Further details regarding a downhole electrical module 118 according to some examples are depicted in FIG. 3. The electrical module 118 includes a modulation transformer 202 for separating the AC power signal and the data signal from the combined signal 117 on the shared communication medium 116. As noted above, a data signal is carried on the shared communication medium 116 in differential mode, while the AC power signal is carried on the shared communication medium 116 in common mode. The modulation transformer 202 is able to subtract the signals on the wires of the twisted wire pair 116 to produce a data signal 203, which is provided at the output 204 of the modulation transformer 202. The output data signal 203 is provided to a telemetry module 206, which can be a modem in some examples. Note that the output data signal 203 can be a command sent to the downhole electrical module 118 to actuate the module 118. Note also that data signal can also flow in the opposite direction, from the telemetry module 206 through the modulation transformer 202 to the twisted wire pair 116.

The modulation transformer 202 is able to sum the signals on the wires of the twisted wired pair 116 to provide a common mode signal at output 208 in FIG. 3. The common mode signal is the AP power signal 207, which is provided to an input of a switch 210.

The switch 210 is some examples can be an electronic switch, rather than an electro-mechanical relay that can consume relatively large amounts of power. In some examples, the electronic switch 210 is a semiconductor switch that is formed using semiconductor technology. The semiconductor switch can be a bidirectional (bilateral) triode thyristor. An example bidirectional triode thyristor 302 is shown in FIG. 4, which has terminals 304 and 306 and a gate terminal 308. A control signal can be provided to the gate terminal 308 to trigger flow of current between the terminals 304 and 306 through the bidirectional triode thyristor 302. Current can flow in either direction.

In other examples, the electronic switch 210 can include transistor(s), such as power transistor(s) to allow power communication through the electronic switch 210.

The output of the electronic switch 210 is connected to an electrical component 212 that is to be powered by the AC power signal 207 provided through the electronic switch 210. In some examples, the electrical component 212 can be an electro-hydraulic actuator that has a motor 214, a hydraulic pump 216, and an actuator 218 that has a piston 220 moveable by hydraulic pressure created by the hydraulic pump 216. In other examples, other types of electrical components can be powered by power delivered through the electronic switch 210 of FIG. 3.

A capacitor 222 in the electrical component 212 allows for a phase shift to drive the motor 214.

The telemetry module 206 provides an output to the electronic switch 210 (such as to the gate 308 of the thyristor 302 of FIG. 4). The output of the telemetry module 206 can provide a command to the electronic switch 210 to activate or deactivate the electronic switch 210, in response to control signaling received over the shared communication medium 116.

In some examples, the actuator 218 can include a position sensor 224 to measure a position of the piston 220. The measured position can be communicated by the position sensor 224 over communication line 226 to the telemetry module 206, which can provide a data signal representing the measured position through the modulation transformer 202 to the twisted wire pair 116 for communication to the surface unit 100.

Although a specific arrangement is depicted in FIG. 3, note that in other implementations, other arrangements of a downhole electronic module 118 can be used. For example, some of the downhole electronic modules 118 can include electro-hydraulic actuators as discussed above, while others of the downhole electronic modules can include other types of devices, such as sensors, flow control devices, and so forth.

Figure 5:
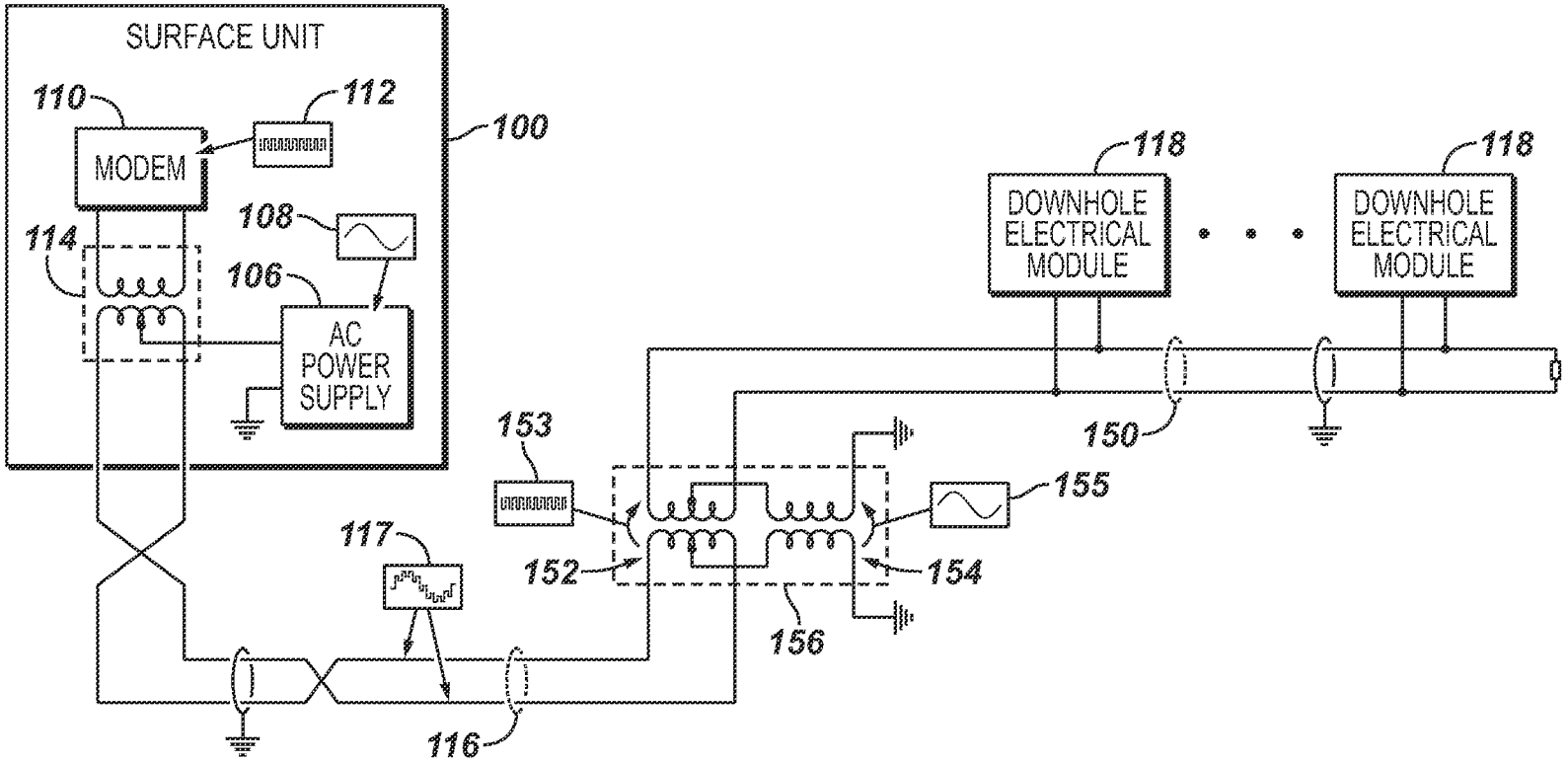

FIG. 5 illustrates an example arrangement that is a variant of the FIG. 2 arrangement. Similar components in FIG. 5 are assigned the same reference numerals as in FIG. 2. In the FIG. 5 arrangement, an inductive coupler 156 (including two pairs 152 and 154 of coils for communicating respective signals 153 and 155, respectively) are provided to allow communication with the shared communication medium 116 (e.g. twisted wire pair) and another shared communication medium 150, without having to provide for electrical connection between the shared communication media 116 and 150.

An inductive coupler performs communication (data and/or power) using induction between the inductive coupler portions (e.g. coils) of the inductive coupler.

The pairs 152 and 154 of coils provide a transformer that is able to perform signal summation (to extract a common-mode signal) and signal subtraction (to provide a differential-mode signal) such that the AC power signal and data signal can be coupled through the inductive coupler 156.

The downhole electrical modules 118 are connected in parallel to the shared communication medium 150. The components of the downhole electrical modules 118 can be similar to those depicted in FIG. 3, for example.

Figure 6:
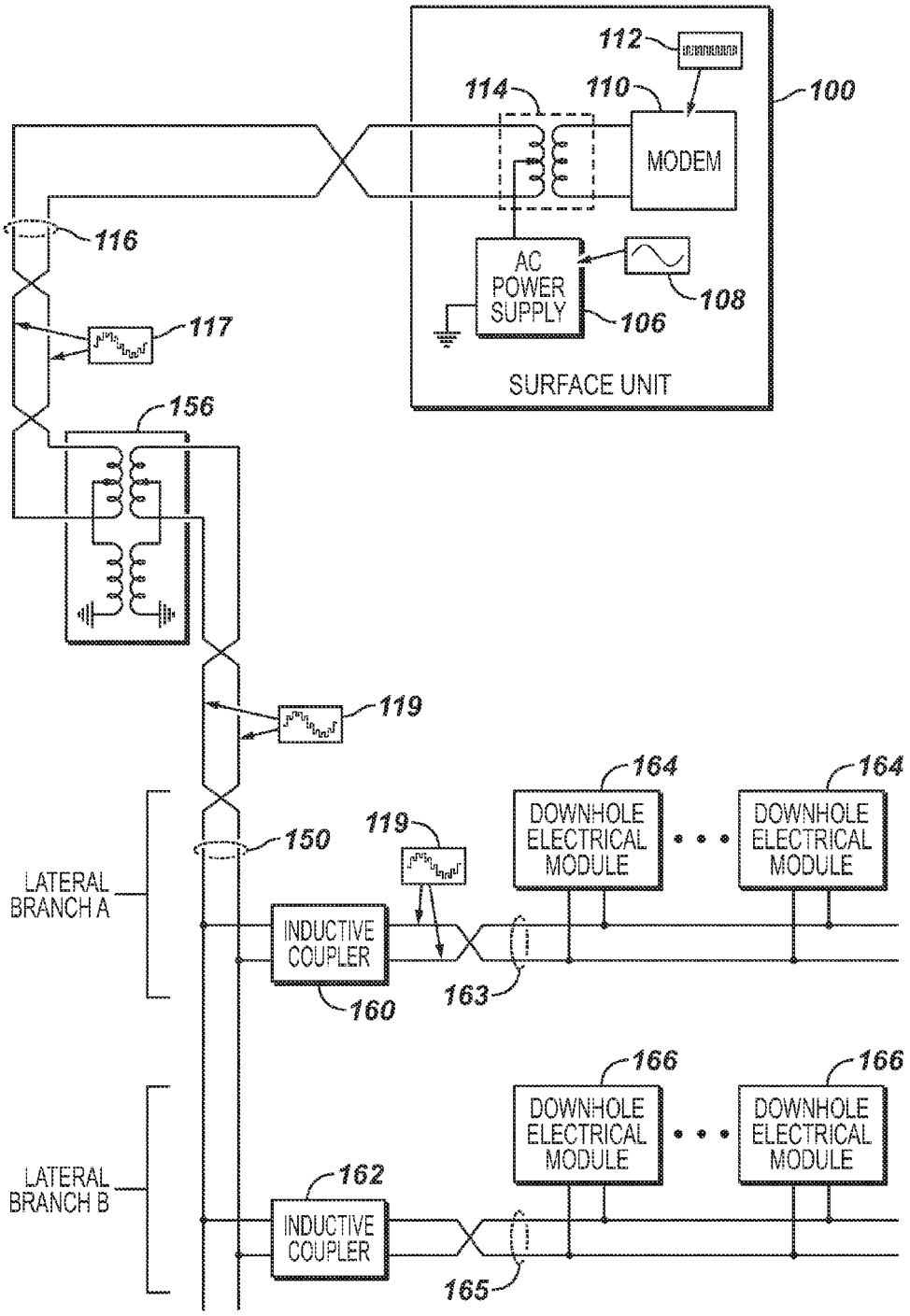

FIG. 6 illustrates an example arrangement that is a variant of the FIG. 5 arrangement. Similar components in FIG. 6 are assigned the same reference numerals as in FIG. 5. The arrangement of FIG. 6 is for use in a multilateral well having lateral branches A and B that extend from a main wellbore. In FIG. 6, the inductive coupler 156 couples data and power between the shared communication media 116 and 150 (e.g. a combined signal 117 is inductively coupled through the inductive coupler 156 and output as a combined signal 119).

In addition, an inductive coupler 160 (similar in design to the inductive coupler 156) is able to inductively couple power and data between the shared communication medium 150 and a shared communication medium 163, which is connected to downhole electrical modules 164 in lateral branch A.

Similarly, an inductive coupler 162 (similar in design to the inductive coupler 156) is able to inductively couple power and data between the shared communication medium 150 and a shared communication medium 165, which is connected to downhole electrical modules 166 in lateral branch B. Deployment of additional inductive couplers would allow for communication of power and data with equipment in additional lateral branches.

Figure 7:
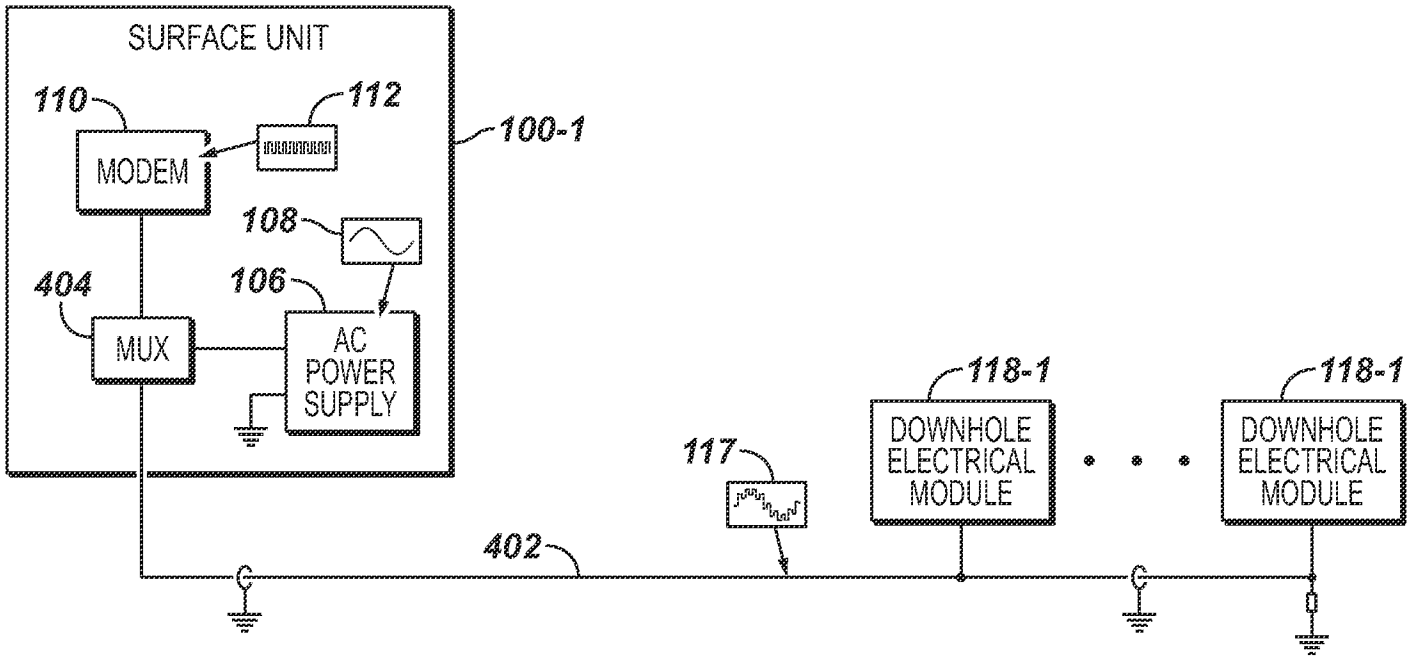

FIG. 7 shows an arrangement according to another example, in which a surface unit 100-1 is coupled over a coaxial cable 402 to electrical modules 118. The coaxial cable 402 can have an internal conductor that is surrounded by a conducting shield. An insulating layer is provided between the conducting shield (which can be a tubular conducting shield) and the inner conductor.

The surface unit 100-1 includes the AC power supply 106 and telemetry module 110. However, instead of a modulation transformer as in the surface unit 100 of FIG. 2, the surface unit 100-1 includes a multiplexer 404 that is able to combine the AC power signal 108 output by the AC power supply 106 and the data signal 112 output by the telemetry module 110 for provision as combined signal 117 over the coaxial cable 402.

Downhole electrical modules 118-1 are connected to the coaxial cable 402 to receive the AC power and data signals communicated over the coaxial cable 402. The coaxial cable 402 can also be used to communicate data signals in the uphole direction from the downhole electrical modules 118 to the surface unit 100-1.

Figure 8:
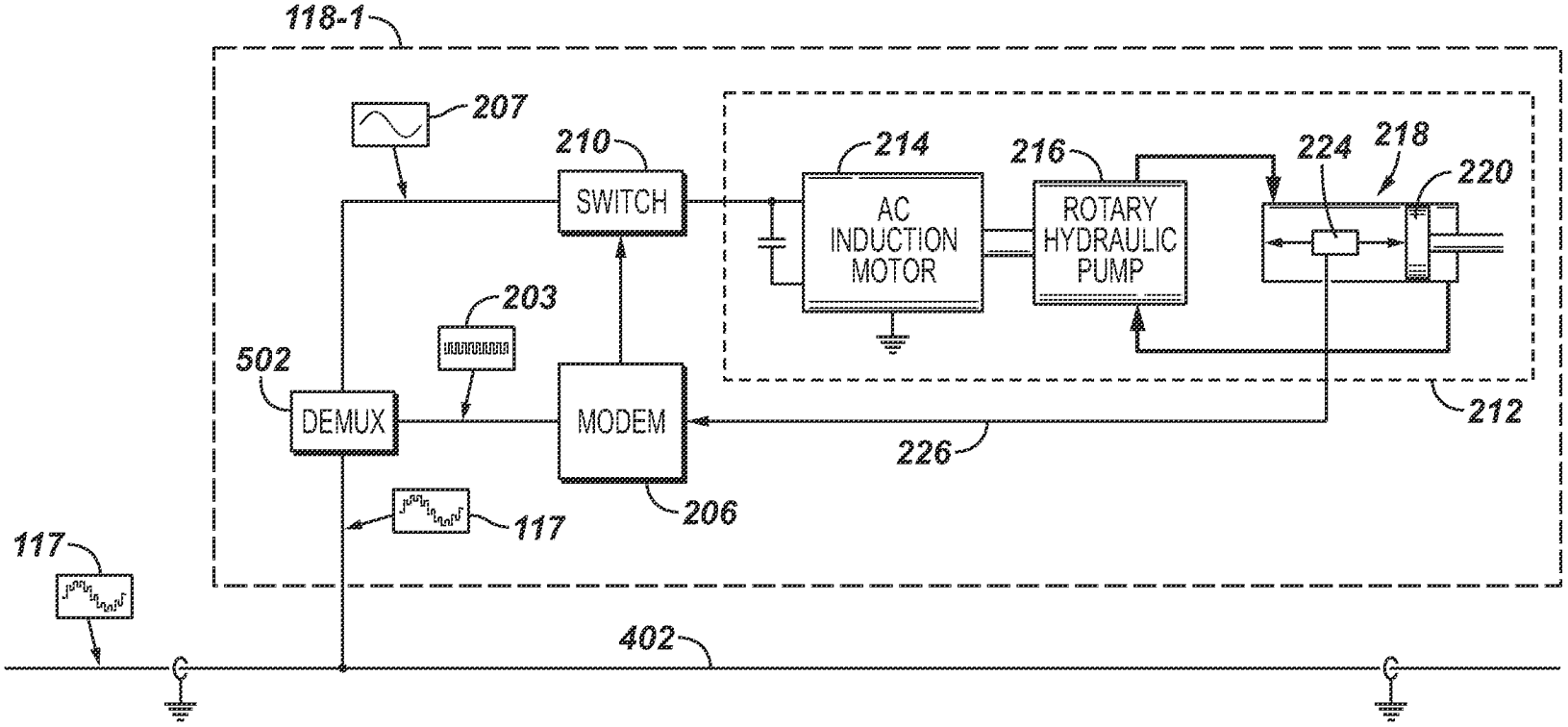

FIG. 8 illustrates example components that can be used in a downhole electrical module 118-1. In the downhole electrical module 118-1, instead of the modulation transformer 202 used in the downhole electrical module 118 of FIG. 3, the downhole electrical module 118-1 includes a demultiplexer to separate high-frequency components (including the data signal 203) from low-frequency components (including the AC power signal 207). In some examples, the demultiplexer 502 can include a high-pass filter to extract high-frequency components, and a low-pass filter to extract low-frequency components.

The data signal 203 output by the demultiplexer 502 is provided to the telemetry module 206, and the AC power signal 207 output by the demultiplexer 502 is provided to the input of the electronic switch 210, which is able to couple the AC power signal 207 to the electrical component 212.

Figure 9:
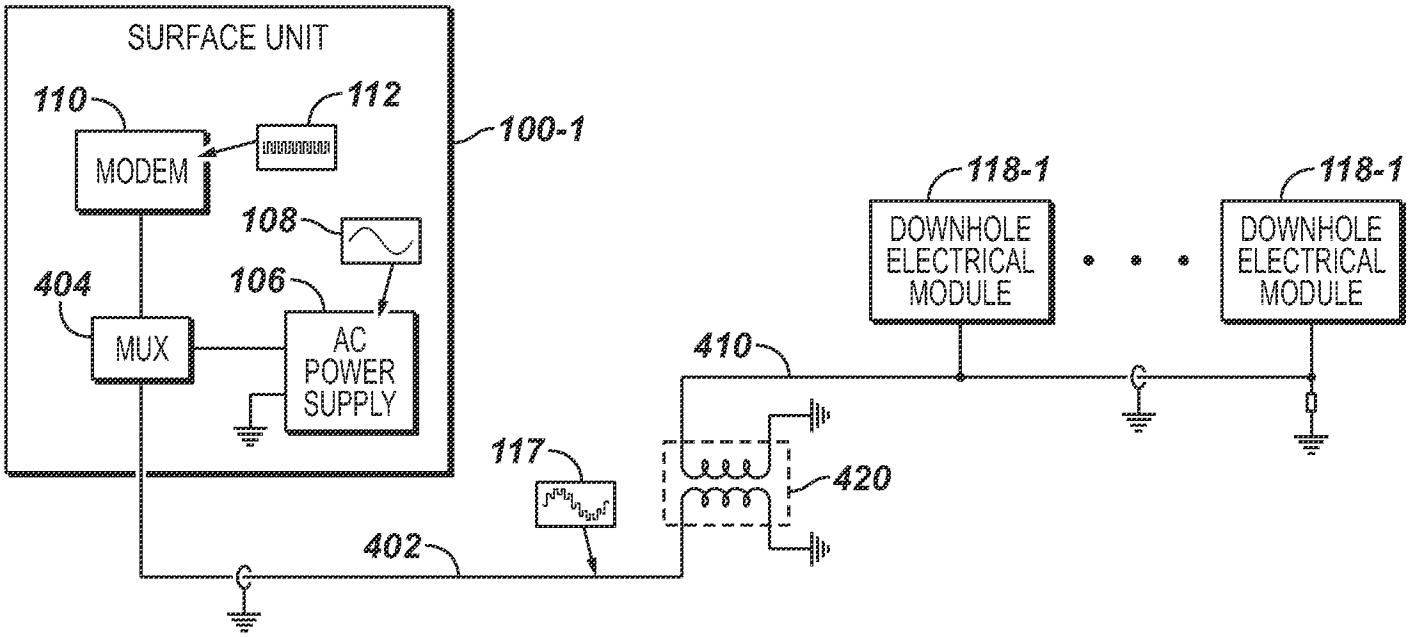

FIG. 9 illustrates an example arrangement that is a variant of the FIG. 7 arrangement. Similar components in FIG. 9 are assigned the same reference numerals as in FIG. 7. The example arrangement of FIG. 9 includes an inductive coupler 420 to inductive power and data signals between the coaxial cable 402 and another coaxial cable 410 that is connected to the downhole electrical modules 118-1.

Figure 10:
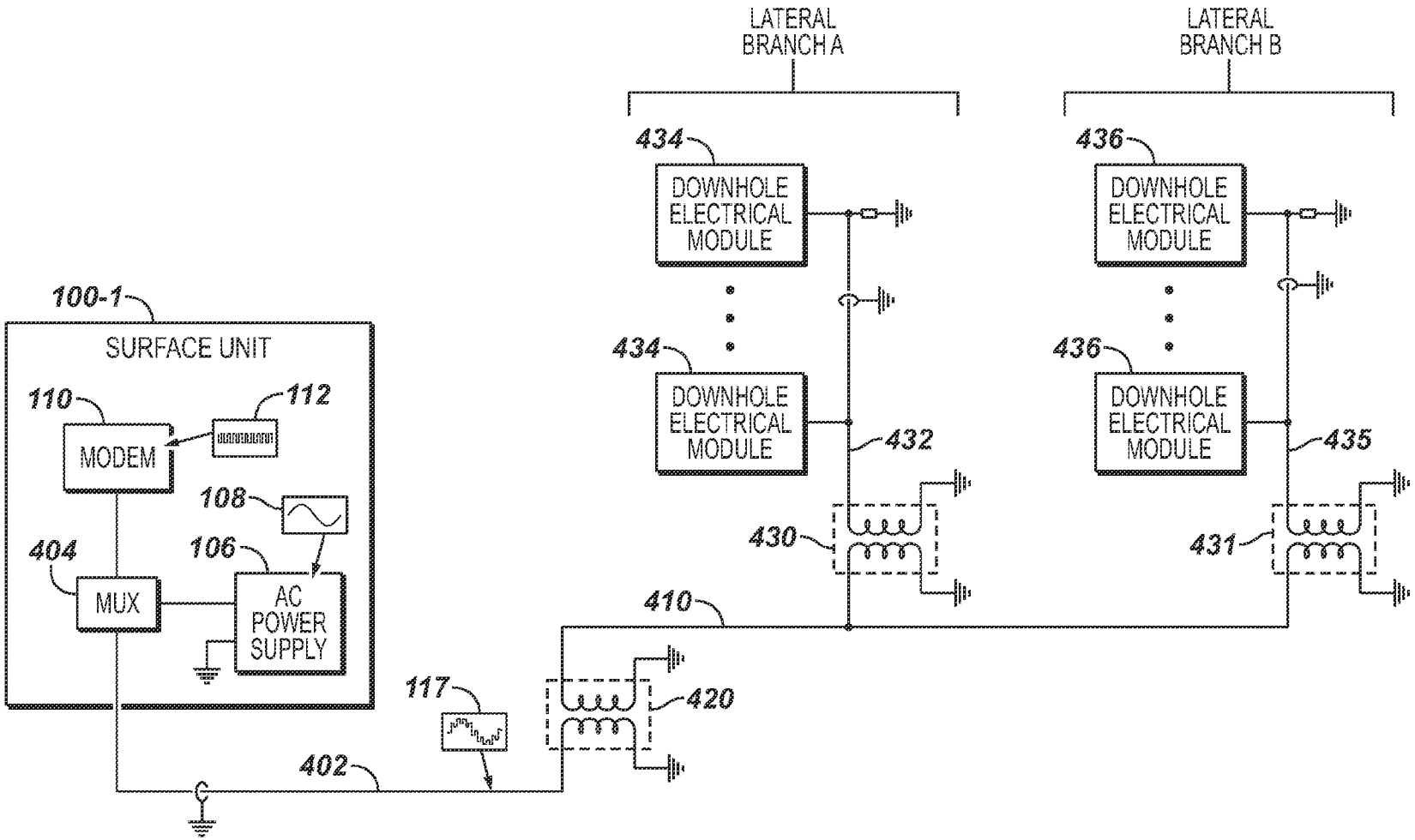

FIG. 10 illustrates an example arrangement that is a variant of the FIG. 9 arrangement. Similar components in FIG. 10 are assigned the same reference numerals as in FIG. 9. The arrangement of FIG. 10 is for use in a multilateral well having lateral branches A and B that extend from a main wellbore. In FIG. 10, the inductive coupler 420 couples data and power between the coaxial cables 402 and 410.

In addition, an inductive coupler 430 (similar in design to the inductive coupler 420) is able to inductively couple power and data between the coaxial cable 410 and a coaxial cable 432, which is connected to downhole electrical modules 434 in lateral branch A.

Similarly, an inductive coupler 431 (similar in design to the inductive coupler 410) is able to inductively couple power and data between the coaxial cable 410 and a coaxial cable 435, which is connected to downhole electrical modules 436 in lateral branch B.

Figure 11:
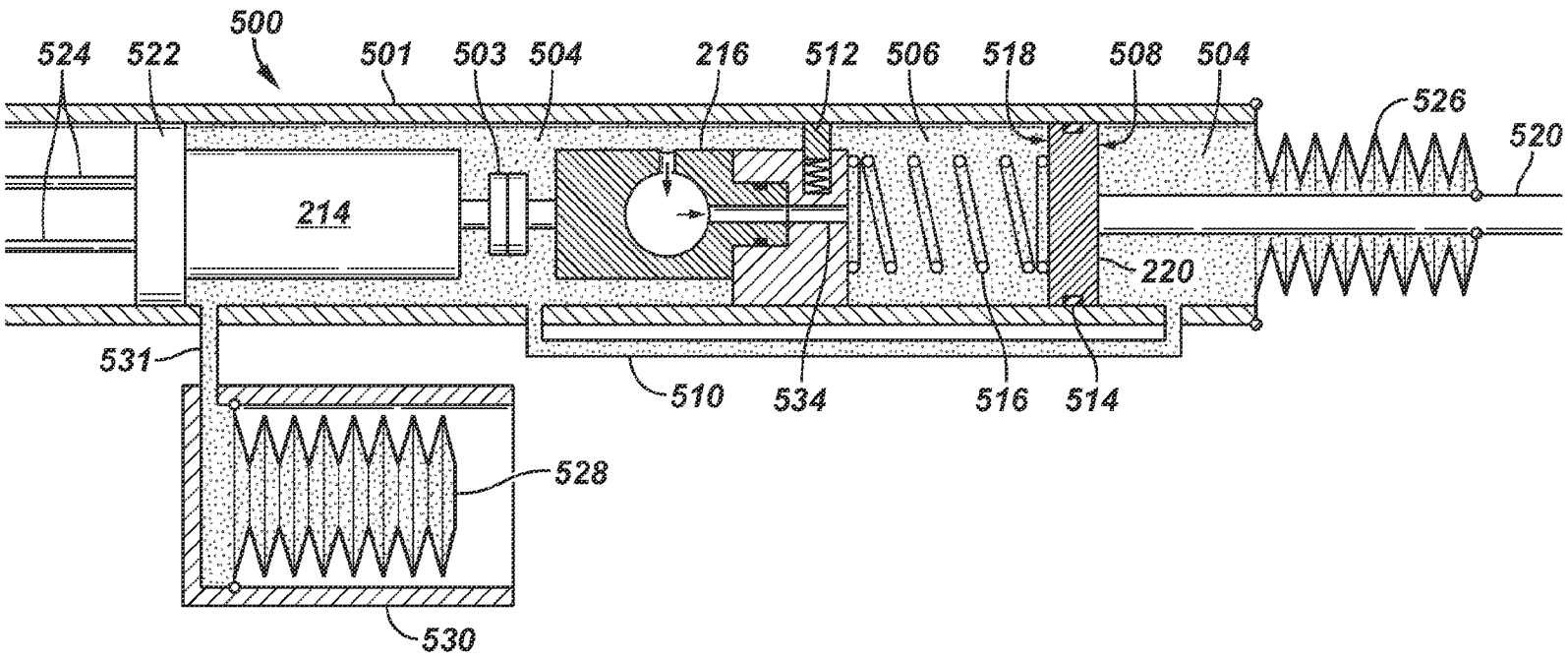
FIGS. 11, 13, and 15 are schematic diagrams of electro-hydraulic actuators according to various implementations.

FIG. 11 is a side schematic view of an electro-hydraulic actuator 500, which is an example of the electrical component 212 depicted in FIG. 3 or 8. In accordance with some implementations, the electro-hydraulic actuator 500 does not employ elastomeric seals (either static or dynamic) that are in contact with wellbore fluids. Use of elastomeric seals that are exposed to wellbore fluids in a downhole tool can result in reduced reliability of the tool, since the elastomeric seals may fail at some point over time. Thus, tools that include elastomeric seals that are exposed to wellbore fluids may not be appropriate for use in permanent installations in a well.

The electro-hydraulic actuator 500 has an outer housing 501 (e.g. metal housing), which contains a first chamber 504 and a second chamber 506, which are filled with a hydraulic fluid (the first and second chambers 504 and 506 constitute first and second hydraulic chambers). The first chamber 504 has two parts: a first part on the left of the second chamber 506, and a second part on the right of the chamber 506. The first part of the first chamber 504, which is defined in part by a bulkhead 522, includes the motor 214 and the hydraulic pump 216. Wires 524 extend through the bulkhead 522 to the motor 214.

The second part of the first chamber 504 is adjacent the right side 508 of the piston 220 (which is sealingly engaged due to presence of a seal 514 with the housing 501). A fluid path 510 interconnects the first and second parts of the first chamber 504. In some examples, the fluid path 510 can be provided by a tube welded to the outer housing 502—in other examples, other types of fluid paths can be employed.

When a valve 512 (which can be a solenoid valve or other type of valve) is closed, the second chamber 506 is isolated from the first chamber. Note that an O-ring seal can be provided on the piston 220 to engage an inner surface of the outer housing 502 to provide sealing engagement between the piston 220 and the outer housing 502.

A tension spring 516 is located in the second chamber 506, on the left side 518 of the piston 220. The tension spring 516 tends to pull the piston 220 to the left (in the diagram) and can create sufficient pulling force to place the piston 220 and actuator rod 520 connected to the piston 220 in a first position when pressure is balanced between the first and second chambers 504 and 506. In other examples, instead of using the tension spring 516, a compression spring can be used instead, where the compression spring is placed on the right side 508 of the piston 220.

Since the first chamber 504 is the only one of the two chambers 504 and 506 that potentially is in contact with wellbore fluids, welded metal bellows 526 and 528 can be used to create a fully enclosed first chamber 504. The bellow 526 is welded to the outer housing 502 and the actuator rod 520. The bellow 526 is deformable to allow longitudinal movement of the actuator rod 520 when hydraulically actuated by the pump 216. In other examples, the bellow 526 can have another arrangement.

The bellow 528 is placed in a tubular structure 530, and is welded to the tubular structure 530. One side of the bellow 528 is in fluid communication with the first chamber 504 through fluid path 531. The bellow 528 provides pressure compensation of the first chamber 504 with respect to the external well pressure. The combination of the bellow 528 and the tubular structure 530 provides an equalizing device to equalize the pressure inside the first chamber 504 with the wellbore pressure.

In operation, the motor 502 is activated, such as by use of the electronic switch 210 of FIG. 3 or 8 to couple AC power to the motor 502. The motor 214 is connected to the hydraulic pump 216 by a coupling 503. Activation of the motor 214 causes the hydraulic pump 216 to pump hydraulic fluid through an output path 534 into the second chamber 506, which builds up pressure to move the piston 220. Depending on the applied pressure, an equilibrium position of the piston 220 is reached. The pump 216 allows sufficient pressure to build to cause the piston 220 and the actuator rod 520 to move from the first position to a second position.

To move the piston 220 and actuator rod 520 back from the second position to the first position, the valve 512 can be opened (by use of a command) to allow fluid communication between the first and second chambers 504 and 506, which balances the pressure between the two chambers. Once the pressure in the chambers 504 and 506 are balanced, the tension spring 516 is able to move the piston 220 and actuator rod 520 back to the first position.

Figure 12:
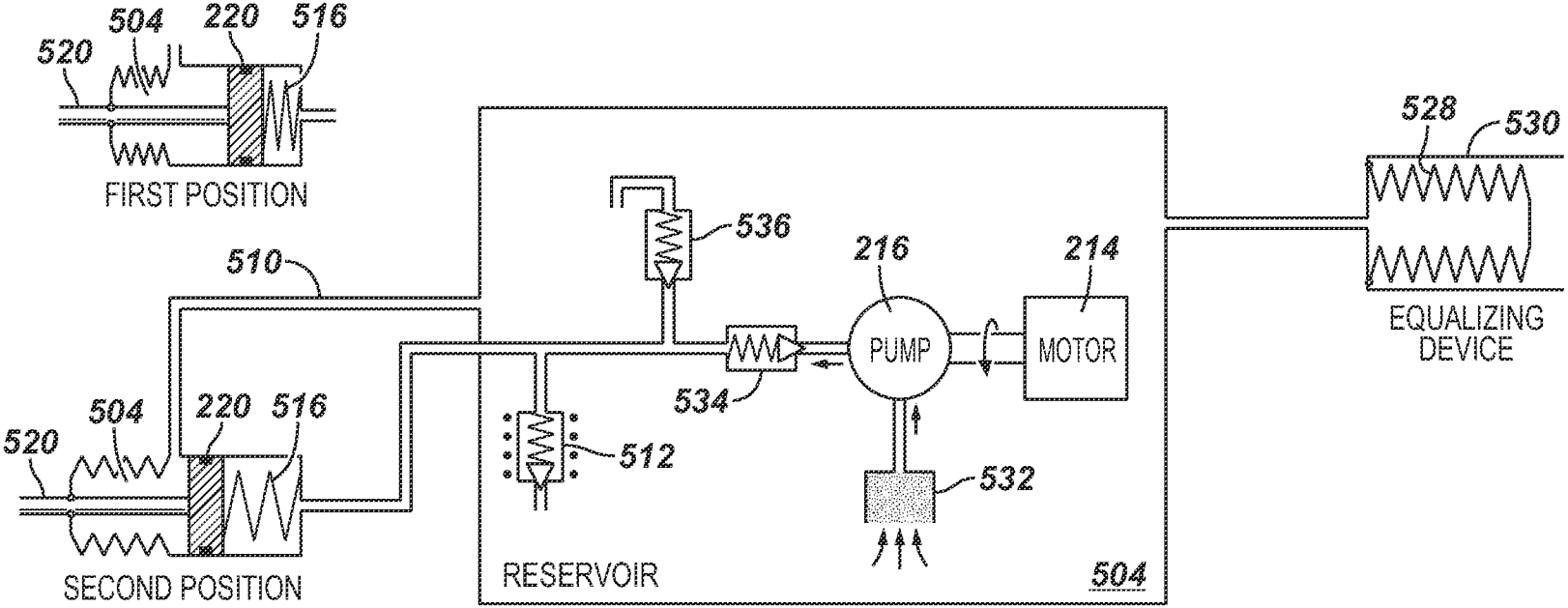
FIGS. 12 and 14 are hydraulic diagrams of the arrangements of FIGS. 11 and 13, respectively.

A hydraulic diagram for the arrangement of FIG. 11 is depicted in FIG. 12. Elements in the hydraulic diagram of FIG. 12 that correspond to the elements of FIG. 11 are assigned the same reference numerals. The intake of the pump 216 in FIG. 12 is connected to receive fluid from a fluid reservoir (which is part of the first chamber 504) through a filter 532. A check valve 534 and relief valve 536 are placed at the output of the pump 216 to, respectively, avoid flow back and to control the maximum pressure of the pump 216. Controlling the maximum pressure of the pump 216 allows the amount of power drawn by the motor 214 to be controlled. The first and second positions of the piston 220 and actuator rod 520 are depicted in FIG. 12.

Figure 13:
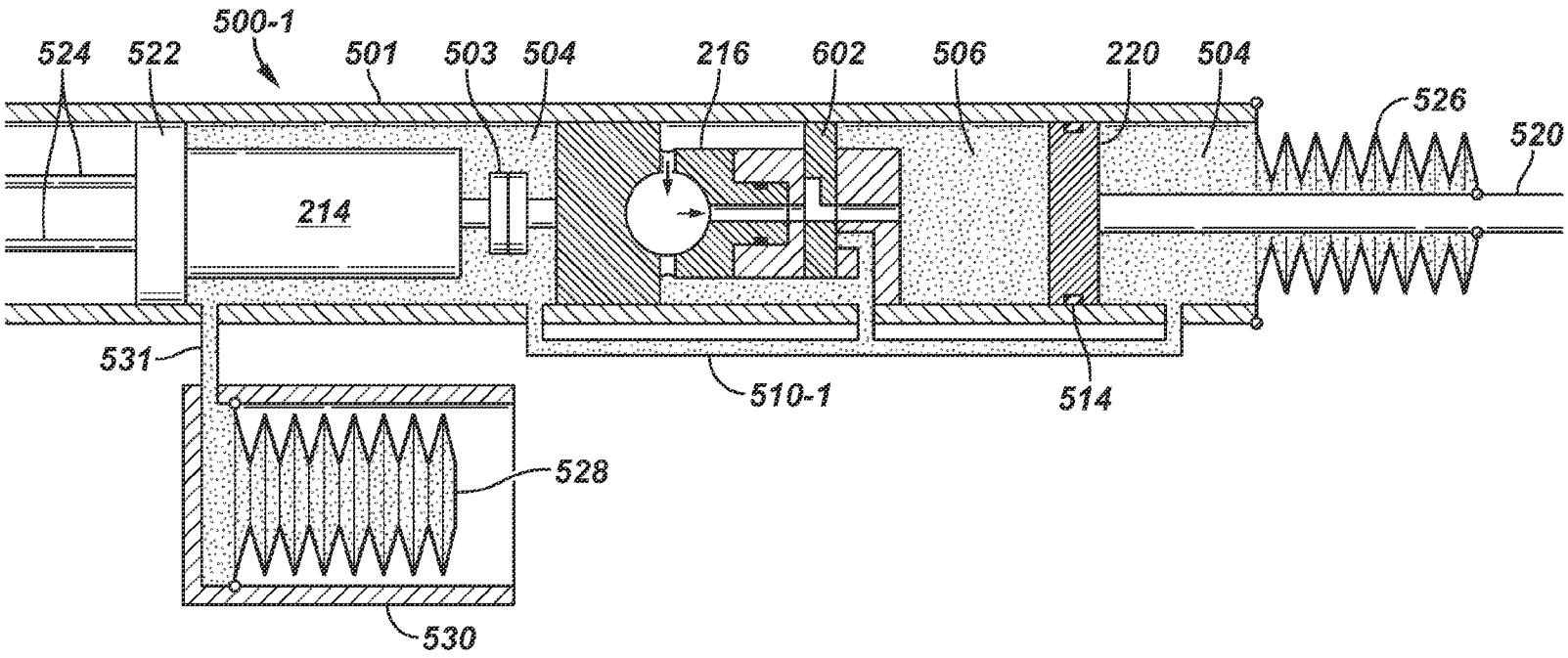

FIG. 13 depicts a different electro-hydraulic actuator 500-1 that does not include the tension spring 516 and valve 512 of FIG. 11. Instead, a hydraulic distributor 602 is used. The components of the electro-hydraulic actuator 500-1 that are similar to the corresponding components of the electro-hydraulic actuator 500 are assigned the same reference numerals.

In the FIG. 13 arrangement, the intake of the pump 216 is not connected to the fluid reservoir, but instead, the fluid reservoir is connected through the first chamber 504 to the pump intake. In FIG. 13, a fluid path 510-1 interconnects the first and second parts of the first chamber 504. In addition, the fluid path 510-1 is connected to an output port of the hydraulic distributor 602.

The hydraulic distributor 602 has two positions. In FIG. 13, the hydraulic distributor 602 is in its top position. In this position, the fluid path from the second chamber 506 to the pump intake is closed, while the fluid path from the right part of the first chamber 504 (on the right of the piston 220 in FIG. 13) and the fluid reservoir to the pump intake is open. In this position, when the pump 216 is activated, the hydraulic fluid will circulate from the reservoir to the second chamber 506 (on the left of the piston 220). Pressure then builds up to move the piston 220 from its first position to the second position.

The hydraulic distributor 602 also has a bottom position. In the bottom position, the fluid path from the reservoir to the pump intake is closed, while the fluid path from the second chamber 506 (left of the piston 220) to the pump intake is open. The pump output is connected to the second part of the first chamber (right side of the piston 220) and the reservoir. As a result, when the pump is activated, the fluid will circulate from the second chamber 506 (left of the piston 220) to the reservoir, which creates a pressure drop in the second chamber 506. The pressure drop causes a differential pressure to develop across the piston 220, which moves the piston 220 back to its first position.

Figure 14:
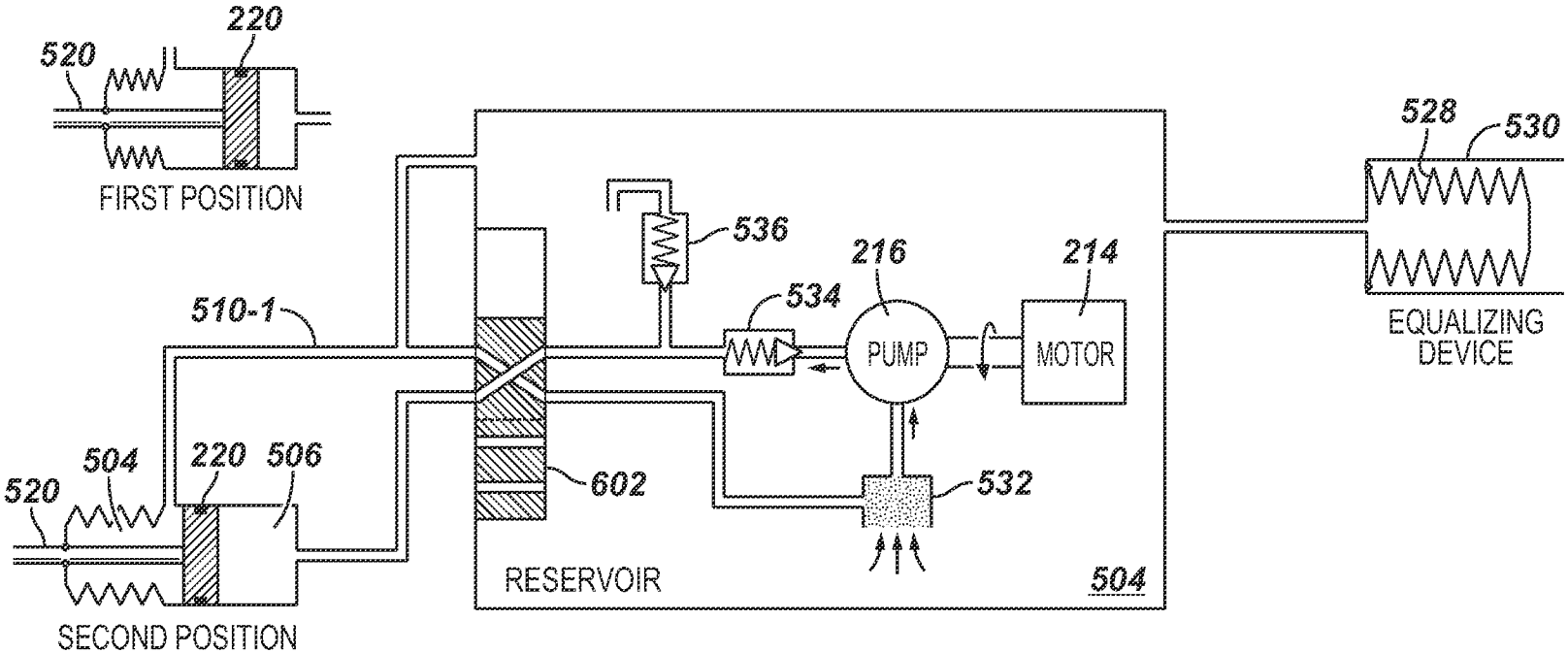

FIG. 14 depicts the hydraulic diagram of the arrangement of FIG. 13 that includes the hydraulic distributor 602.

Figure 15:
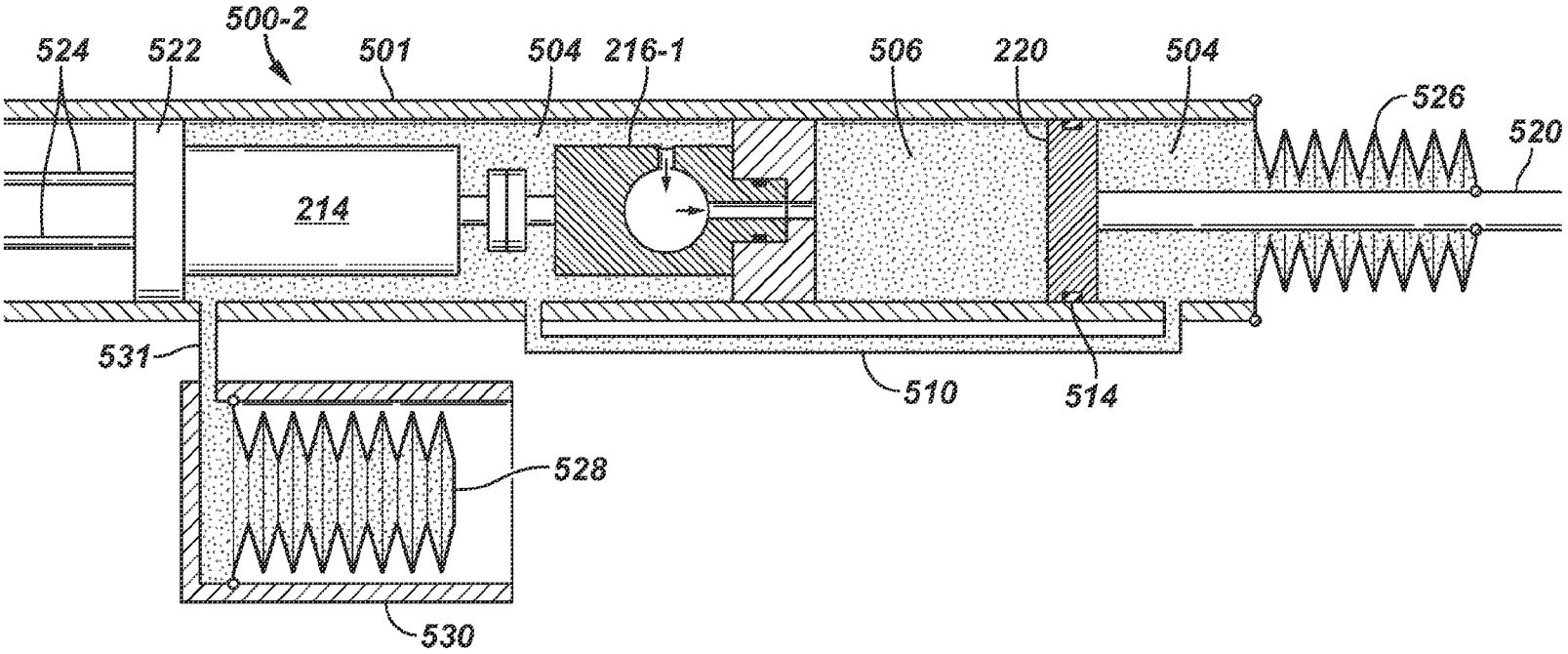

FIG. 15 depicts another example electro-hydraulic actuator 500-2. This electro-hydraulic actuator 500-2 uses a reversible pump 216-1. The electro-hydraulic actuator 500-2 does not include the tension spring 516 and valve 512 of FIG. 11, nor the hydraulic distributor 602 of FIG. 13.

When the reversible pump 216-1 flows from the first chamber 504 to the second chamber 506, this will over-pressurize the second chamber 506 to move the piston 220 from the first position to the second position.

On the other hand, when the pump flow is reversed, this will under-pressurize the second chamber 506 and make the piston 220 move from the second position to the first position.

In the foregoing description, numerous details are set forth to provide an understanding of the subject disclosed herein. However, implementations may be practiced without some or all of these details. Other implementations may include modifications and variations from the details discussed above. It is intended that the appended claims cover such modifications and variations.

What is claimed is:

1. An apparatus comprising:

a surface unit having a power supply, configured to deliver a combined signal with an alternating current (AC) power signal and a data signal to a plurality of downhole electrical modules coupled to a communication medium having at least one of a twisted wire pair and a coaxial cable, each downhole electrical module of the downhole electrical modules comprising:

a downhole electrical component for use in a well;

a circuit to receive the AC power signal and the data signal over the communication medium, the circuit to separate the AC power signal and the data signal, the circuit being positioned between the surface unit and the downhole electrical component; and an electronic switch to couple the AC power signal output by the circuit to the downhole electrical component for use in the well, the downhole electrical component comprising an electro-hydraulic actuator, wherein the electro-hydraulic actuator having:

an outer housing defining a first hydraulic chamber and a second hydraulic chamber;

a piston;

a pump to apply fluid pressure to the second hydraulic chamber to cause movement of the piston from a first position to a second position; and a first bellow to provide a fluid seal for the first hydraulic chamber from a well region outside the first hydraulic chamber without use of an elastomeric seal; and a modulation transformer having an inductive coupler comprising pairs of coils disposed along the communication medium, the modulation transformer separating the AC power signal and the data signal from the combined signal on the communication medium, the AC power signal being carried on the communication medium in common mode and the data signal being carried on the communication medium in differential mode, the modulation transformer subtracting signals on the communication medium to produce the data signal which is provided to a telemetry module of said each downhole electrical module, the modulation transformer further summing signals on the communication medium to provide a common mode signal, in the form of the AC power signal, which is provided to an input of the electronic switch, the plurality of downhole electrical modules being connected in parallel to the communication medium.

2. The apparatus of claim 1, wherein the circuit includes a modulation transformer.

3. The apparatus of claim 1, wherein the circuit includes a demultiplexer to separate a first component having a higher frequency in a signal from a second component having a lower frequency in the signal.

4. The apparatus of claim 1, further comprising a telemetry module to receive the data signal output by the circuit.

5. The apparatus of claim 1, wherein an output of said each of the downhole electrical module is connected to the electronic switch, the output to provide a command to the electronic switch to activate or deactivate the electronic switch.

6. The apparatus of claim 1, wherein the electronic switch includes a semiconductor switch bidirectional (bilateral) triode thyristor.

7. The apparatus of claim 1, wherein the electronic switch includes a component selected from the group consisting of a bidirectional triode thyristor and a power transistor.

8. A system comprising:

a surface unit having a power supply and a telemetry module;

a downhole electrical module for positioning in a well;

a shared communication medium to communicate a combined signal with an alternating current (AC) power signal and a data signal between the surface unit and the downhole electrical module, wherein the downhole electrical module includes:

an electrical component comprising an electro-hydraulic actuator having:

an outer housing defining a first hydraulic chamber and a second hydraulic chamber;

a piston;

a pump to apply fluid pressure to the second hydraulic chamber to cause movement of the piston from a first position to a second position; and a first bellow to provide a fluid seal for the first hydraulic chamber from a well region outside the first hydraulic chamber without use of an elastomeric seal;

a circuit to receive the AC power signal and the data signal over the shared communication medium and to separate the AC power signal from the data signal; and an electronic switch to couple the AC power signal output by the circuit to the electrical component; and a modulation transformer having an inductive coupler comprising coils disposed along the shared communication medium, the inductive coupler enabling transfer of the AC power signal and the data signal along the shared communication medium, the AC power signal and the data signal being communicated with respect to the downhole electrical module, wherein the modulation transformer separating the AC power signal and the data signal from the combined signal on the communication medium, the AC power signal being carried on the communication medium in common mode and the data signal being carried on the communication medium in differential mode, the modulation transformer subtracting signals on the communication medium to produce the data signal which is provided to the telemetry module, the modulation transformer further summing signals on the communication medium to provide a common mode signal, in the form of the AC power signal, which is provided to an input of the electronic switch, a plurality of downhole electrical modules being connected in parallel to the communication medium.

9. The system of claim 8, further comprising a second downhole electrical module that is connected to the shared communication medium, the second downhole electrical module including a second electrical component to be powered by the AC power signal communicated over the shared communication medium, the second electrical component being of a type different from the electro-hydraulic actuator.

10. The system of claim 8, wherein the downhole electrical module and the shared communication medium are for positioning in a lateral branch.

11. The system of claim 8, wherein the circuit includes a component selected from the group consisting of a modulation transformer and a demultiplexer.

12. The system of claim 8, wherein the electronic switch comprises a semiconductor switch.

* * * * *